United States Patent [19]

Smalley

[11] 4,394,916

[45] Jul. 26, 1983

[54] CHILD-RESISTANT CLOSURE ASSEMBLY

[75] Inventor: Ned J. Smalley, Perrysburg, Ohio

[73] Assignee: Owens-Illinois, Inc., Toledo, Ohio

[21] Appl. No.: 362,584

[22] Filed: Mar. 29, 1982

[51] Int. Cl.[3] ..... B65D 55/02

[52] U.S. Cl. ..... 215/220

[58] Field of Search ..... 215/219, 220

[56] References Cited

U.S. PATENT DOCUMENTS

| | | | |
|---|---|---|---|
| 3,857,505 | 12/1974 | Mumford et al. | 215/220 |
| 4,011,960 | 3/1977 | Mauvernay | 215/220 |
| 4,020,965 | 5/1977 | Northup | 215/220 |
| 4,281,771 | 8/1981 | Siegel | 215/220 |

*Primary Examiner*—George T. Hall

*Attorney, Agent, or Firm*—John R. Nelson; Myron E. Click

[57] ABSTRACT

A child-resistant closure assembly is disclosed which includes inner and outer cap members in a nested configuration. Leaf spring and ratchet elements are respectively provided on the cap members whereby torque can normally be transmitted from the outer cap member to the inner cap member only in the closure tightening direction. For transmission of torque in the closure removal direction, drive lugs on the inner cap member are engageable in non-concentric apertures formed in the panel of the outer cap member. The drive lugs and apertures are normally maintained axially out of engagement by the leaf springs formed on one of the cap members. When the leaf springs and ratchet elements are transmitting closure tightening torque, the non-concentric apertures are angularly displaced relative to the drive lugs. The apertures may be visually aligned with the driving lugs by reverse rotation of the outer cap and then the outer cap is axially shifted to engage the driving lugs in the apertures for removal of the closure assembly.

4 Claims, 3 Drawing Figures

CHILD-RESISTANT CLOSURE ASSEMBLY

BACKGROUND OF THE INVENTION

1. Field of the Invention

The invention relates in general to child-resistant closures and in particular to a closure assembly including inner and outer nested caps, the outer cap having an aperture formed therein to permit visual alignment of the caps for easy removal.

2. Description of the Prior Art

Two piece child-resistant closures are known in the art in a variety of specific forms. Typically, such closure assemblies comprise two nested cap members, each cap including a disc-shaped panel and an annular skirt depending from the periphery of the panel. The inside wall of the inner cap skirt includes thread-engaging means for cooperating with a threaded container. Retention means are provided on the cap members for retaining the inner member within the outer member, allowing free relative rotational movement and limited axial movement between the two members. Only the outer cap member or shell is accessible for manipulation when the closure assembly is threaded into engagement on a container.

Typically, the cap members include complementary lugs which positively engage for transmission of torque between the two members when the outer member is rotated in a closure tightening direction, but which normally cam or ratched past each other when the outer cap member is rotated in an opposite, closure removal direction. Various special manipulations, which manipulations are beyond the abilities of small children, are required to bring driving lugs into engagement with cooperating driven lugs for transmission of torque in the closure removal direction. In the common "press and turn" two-member closure, resilient means normally separating driving lugs from the driven lugs are overcome by simultaneously pressing and turning the outer cap member. Such closures are disclosed in U.S. Pat. Nos. 3,795,338 and 3,857,505.

U.S. Pat. No. 4,011,960 to Mauvernay et al. discloses a closure assembly comprising two nested closure members which are relatively axially movable between two predetermined positions. In a child-resistant first position, the closure members can rotate freely relative to each other. In the second position, an upstanding projection from the inner cap member panel engages a correspondingly-shaped aperture formed through the outer cap member panel. In this second position, the engagement of the projection in the aperture provides for transmission of removal torque from the outer member to the inner member. However, after the closure is manipulated to the second position, allowing for removal of the closure, it does not automatically return to the child-resistant first position.

SUMMARY OF THE INVENTION

The present invention relates to a closure assembly including two nested cap members, each having a disc-shaped panel and a depending annular skirt. The inside wall of the inner cap member skirt is threaded for engagement with complementary threads formed on the outside surface of a container. The inner cap member is loosely retained within the outer cap member by a retention bead formed on the skirt of the outer member. The nested fit of the inner cap member within the outer cap member allows relative rotational movement and limited axial movement between the two cap members. The panel of the outer cap member has a central aperture including a plurality of peripherally spaced notches, defining generally the shape of a cogwheel. The inner cap member panel includes a plurality of upstanding drive lugs engageable within the notches for transmission of torque between the two cap members.

The panels are normally biased apart by leaf spring members integrally formed on one of the panels. A plurality of peripherally spaced ratchet lugs are formed on the opposite panel such that the leaf springs will freely cam past the drive lugs when the outer cap member is rotated in the closure removal direction, but engage the drive lugs when the outer cap member is rotated in the closure tightening direction. Only when the outer cap member is reversely rotated and pushed downwardly against the bias of the leaf springs, thereby bringing the drive lugs of the inner cap and the notches of the outer cap into engagement, can the closure be removed from the container by further reverse rotation.

The aperture formed in the outer cap member renders the mode of operation of the child-resistant closure assembly readily apparent to an adult user and permits him to visually align the drive lugs of the inner cap in the notches of the outer cap in order to initiate removal of the closure assembly. After the closure assembly is manipulated, the leaf springs automatically return it to the child-resistant configuration, in which the ratchet lugs and leaf springs cooperate to transmit torque between the two cap members in only one direction.

DESCRIPTION OF THE PREFERRED EMBODIMENT

Figure 1:
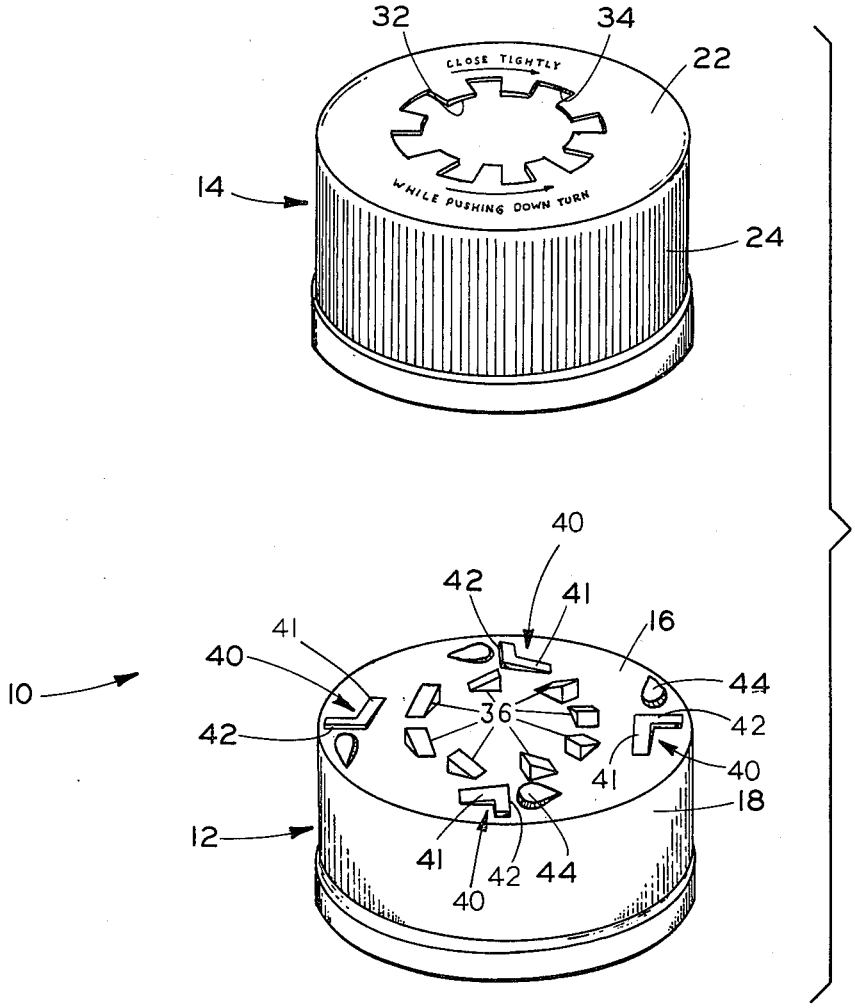
FIG. 1 is an exploded perspective view of the two cap members constituting the child resistant closure assembly of the invention.
Figure 3:
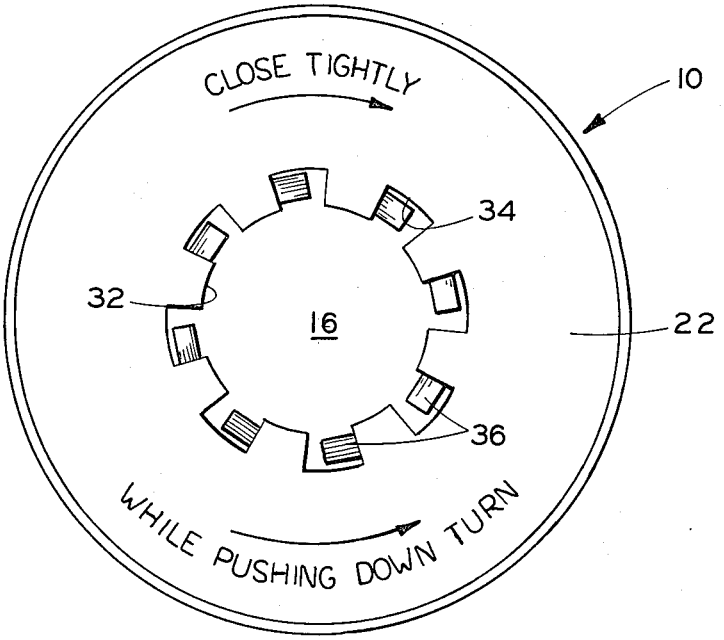
FIG. 3 is a top plan view of the cap members of the closure assembly of FIG. 2.

Referring now to the drawings, there is illustrated a closure assembly 10 in accordance with the present invention. The closure assembly 10 includes an inner cap member 12 and an outer cap member 14. Cap members 12 and 14 are preferably injection molded from a tough thermoplastic material, such as polypropylene, having a limited degree of resilience. As shown clearly in the exploded view of FIG. 1, the inner cap member 12 comprises a disc-shaped panel portion 16 and an annular skirt 18 depending from the periphery thereof. Similarly, the outer cap member 14 includes a disc-shaped panel 22 and a depending annular skirt 24.

Figure 2:
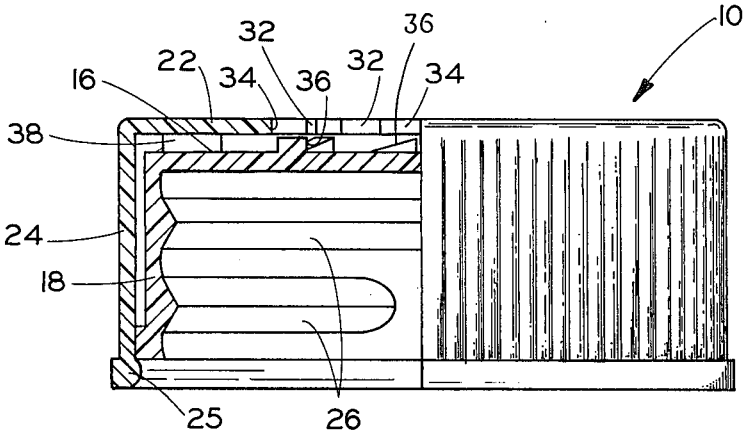
FIG. 2 is an elevational view in quarter section of the cap members illustrated in FIG. 1, shown in nested configuration.

As shown in FIG. 2, the cap members 12 and 14 are assembled in a nested configuration to form the closure assembly 10. The outer cap member 14 loosely encompasses the inner cap member 12 to permit relative rotational movement between the inner and outer cap members 12 and 14. An inwardly-projecting annular bead 25 (FIG. 2) is integrally formed on the inside wall of the lower end of the outer cap skirt 24 for retaining the inner cap member 12 within the outer cap member 14, while permitting limited relative axial movement between the two cap members 12 and 14. A helical thread 26 is formed on the inside wall of the inner cap skirt 18 to cooperate in conventional fashion with complementary threads (not shown) formed on the neck of a container.

A central aperture 32 in the shape of a cogwheel is formed through the panel 22 of the outer cap member 14. The periphery of the aperture 32 includes a plurality of spaced notches 34 representing the "teeth" of the cogwheel shape. The inner cap panel 16 includes a plurality of integrally-formed, upwardly-projecting drive lugs 36 which are spaced apart such that they are received within the notches 34 when the outer cap member 14 is angularly aligned and then pressed downwardly relative to the inner cap member 12. In this position, the engagement of the drive lugs 36 in the notches 34 formed in the aperture 32 allows for the transmission of torque from the outer cap member 14 to the inner cap member 12.

In order to prevent young children from removing the closure assembly 10, however, the inner and outer cap panels 16 and 22 are normally biased apart by a plurality of conventional leaf springs 38. The leaf springs 38 are integrally-formed tabs which extend downwardly from the outer cap panel 22 at an angle of approximately 45°. Two or more such tabs are provided in equi-spaced relation around the periphery of panel 22. The leaf springs 38 bias the inner and outer cap members 12 and 14 to the configuration illustrated in FIG. 2, in which the panels 16 and 22 are at a maximum separation and the lower portion of the inner cap skirt 18 abuts the retention bead 25.

The leaf springs 38 are arranged to cooperate with a plurality of ratchet lugs 40 formed on the upper side of the panel 16 of the inner cap member 12. The ratchet lugs 40 are integrally formed with and project upwardly from the inner cap panel 16. Each ratchet lug 40 has a generally L-shaped configuration including an inclined ramp portion 41 and a vertical detent wall 42. The structure and operation of the leaf springs 38 and the ratchet lugs 40 are explained in detail in U.S. Pat. No. 3,857,505 to Mumford et al., which disclosure is hereby incorporated by reference.

The ratchet lugs 40 and leaf springs 38 are so arranged that when the outer cap member 14 and leaf springs 38 are rotated in a closure removal direction, they will cam past the ratchet lugs 40, aided by the ramps 41. When the leaf springs 38 are rotated in a closure tightening direction, the springs 38 will be stopped by the vertical detent walls 42 and further relative movement will be prevented. Torque can thus be transmitted from the outer cap member 14 to the inner cap member 12 in the closure tightening direction. Hence, simply by rotating the outer cap member 14, the inner cap member 12 can be threaded onto the container. Any attempt to remove the tightened closure assembly 10 by mere rotation of the outer cap member 14 in the closure removal direction will result in the outer cap member 14 simply ratcheting on the inner cap member 12 as the leaf springs 38 cam past the ratchet lugs 40.

To remove the closure assembly 10 from the container, the bias of the leaf springs 38 must be overcome such that the drive lugs 36 are brought into driving engagement with the notches 34 of the aperture 32. By looking through the aperture 32, an adult user can readily comprehend the method of operation of the closure assembly 10 and thereby reversely rotate outer cap 14 to align the drive lugs 36 and notches 34. Thereupon, an axial force directed on the outer cap member 14 against the bias of the leaf springs 38 will move the outer cap member 14 downwardly to bring aperture 32 into engagement with drive lugs 36. While the cap members 12 and 14 are held in this relative axial position, removal torque applied to the outer cap member 14 will be transmitted to the inner member 12. It is unlikely that a child would have the ability to first align aperture 32 with drive lugs 36 and then simultaneously press and turn the outer cap member 14 to effect the removal of the closure assembly 10 from the container. Moreover, the method of operation of the closure assembly 10 would not be as readily discernable to a child as to an adult user.

Various modification of the closure assembly 10 are possible within the scope of the invention. For example, the drive lug means 36 need not comprise separate lugs. Instead, the lug means could comprise corresponding surfaces of a single projection in the shape of a cogwheel extending upwardly from the inner cap panel 16 and insertable within the complementarily-shaped aperture 32. Also, the aperture 32 can be shaped otherwise than as a cogwheel. The essential requirement is that aperture 32 and drive lug means 36 have a non-concentric relationship to the axis of inner cap member 12 so that torque can be transmitted thereto when upstanding lugs 36 are axially inserted in notches 34 of aperture 32.

Although L-shaped ratchet lugs 40 are preferred, it is necessary only to have ratchet lugs of a size and shape that will permit the leaf springs 38 to cam past in the closure removal direction, but will interfere with their movement in the closure tightening direction.

The panel 16 of the inner cap member 12 may also include a plurality of teardrop-shaped detent projections 44 spaced between the ratchet lugs 40, as disclosed in U.S. Pat. No. 3,857,505 to Mumford et al. If the outer cap member 14 is rotated in the closure removal direction without being pressed downwardly, the leaf springs 38 will simply cam past the ratchet lugs 40, as previously described. The detent projections 44 tend to retain the leaf springs 38 in the position attained immediately after the leaf springs 38 have risen up the ramp portions 41 and have sprung downwardly beyond the vertical detent walls 42. The cogwheel-shaped aperture 32 and the drive lugs 36 are so arranged that the drive lugs 36 are not aligned axially below the notches 34 of the aperture 32 in this position. Hence, at any application position, whether inner cap 12 is tightly or loosely applied, an additional reverse rotational movement of outer cap 14 relative to inner cap 12 is necessary to align the drive lugs 36 and notches 34 before the inner and outer cap member 12 and 14 can be drivingly engaged.

The design of the safety closure assembly 10 offers several advantages over the prior art. The use of a cogwheel-shaped aperture 32 for engagement of the driving lugs 36 provides for a closure assembly 10 of lower weight, thereby requiring less material for manufacture. In contrast, the prior art driving lugs comprised additional integrally-molded projections. As explained, the use of the aperture 32 offers the further advantage of permitting an adult user to see how the closure assembly 10 operates, allowing him to visually align the driving lugs 36 with the aperture 32. As an additional safety feature over some prior art closures, the leaf springs 38 provide a constant bias towards the child-resistant configuration. The user is not required to manually reset the closure assembly 10 to attain a child resistant feature.

Lastly, since the great majority of child-resistant closures are initially applied to a container by machine, it is quite important that, when applied, the notches 34 of outer cap 14 are always angularly misaligned with the upstanding drive lugs 36 of inner cap 12, thus requiring a manual reverse rotation to align notches 34 with lugs 36, followed by depression of outer cap 14 relative to inner cap 12 before any removal rotation of inner cap 12 can be initiated.

In accordance with the provisions of the patent statutes, the principal and mode of operation of the present invention have been explained and illustrated in its preferred embodiment. However, it must be appreciated that the invention can be practiced otherwise than as specifically explained and illustrated without departing from its spirit or scope.

What is claimed is:

1. A safety closure assembly for a threaded container neck comprising:

an inner cap member including a top panel and a depending annular skirt, said inner cap skirt having threads formed thereon for engaging the threaded container neck, said inner cap panel having at least one upstanding, non-concentric driving lug formed on the upper surface thereof;

an outer cap member including a top panel and a depending annular skirt, said outer cap member loosely encompassing said inner cap member and permitting relative rotational movement therebetween, and means for retaining said inner cap member within said outer cap member but permitting limited relative axial movements of said inner and outer cap members;

said outer cap panel having a non-concentric aperture formed therein, said driving lug of said inner cap member being axially insertable in said aperture for transmission of torque between said cap members when said cap members are in a first relative axial position;

ratchet lug means on one of said inner cap and outer cap panels;

cooperating leaf spring members on the other of said inner cap and outer cap panels normally biasing said inner and outer cap members to a second relative axial position in which said non-concentric aperture and driving lug are out of engagement, said leaf springs being arranged to drivingly engage said ratchet lugs when said outer cap member is rotated in a closure tightening direction and to cam past said ratchet lugs when said outer cap member is rotated in a closure removal direction; and said non-concentric aperture being angularly misaligned with said upstanding drive lug when said leaf spring members are drivingly engaging said ratchet lugs.

2. The closure assembly defined in claim 1 wherein said non-concentric aperture and driving lug each define the shape of a cogwheel.

3. A safety closure assembly for a threaded container neck comprising:

an inner cap member including a top panel and a depending annular skirt, said inner cap skirt having threads formed thereon for engaging the threaded container neck, said inner cap panel having a plurality of peripherally spaced upstanding driving lugs formed on the upper surface thereof;

an outer cap member including a top panel and a depending annular skirt, said outer cap member loosely encompassing said inner cap member and permitting relative rotational movement therebetween, and means for retaining said inner cap member within said outer cap member but permitting relative axial movements of said inner and outer cap members;

said outer cap panel having a plurality of apertures formed therein to permit the insertion of said driving lugs in said apertures for transmission of torque between said cap members when said cap members are in a first relative axial position;

ratchet lug means on one of said inner cap and outer cap panels;

cooperating leaf spring members on the other of said inner cap and outer cap panels normally biasing said inner and outer cap members to a second relative axial position in which said non-concentric apertures and driving lugs are out of engagement, said leaf springs being arranged to drivingly engage said ratchet lugs when said outer cap member is rotated in a closure tightening direction and to cam past said ratchet lugs when said outer cap member is rotated in a closure removal direction; and said outer cap member apertures being angularly misaligned with said upstanding driving lugs on said inner cap member when said leaf spring members are drivingly engaging said ratchet lugs.

4. A safety closure assembly for a threaded container neck comprising:

an inner cap member incuding a top panel and a depending annular skirt, said inner cap skirt having threads formed thereon for engaging the threaded container neck, said inner cap panel having at least one upstanding, non-concentric driving lug formed on the upper surface thereof;

an outer cap member including a top panel and a depending annular skirt, said outer cap member loosely encompassing said inner cap member and permitting relative rotational movement therebetween, and means for retaining said inner cap member within said outer cap member but permitting limited relative axial movements of said inner and outer cap members;

a plurality of peripherally spaced, upstanding ratchet lugs on said inner cap panel;

a plurality of depending integral leaf spring elements on the bottom surface of said outer cap member normally biasing said inner and outer cap members to a second relative axial position in which said non-concentric aperture and driving lug are out of engagement, said leaf springs being arranged to drivingly engage said ratchet lugs when said outer cap member is rotated in a closure tightening direction and to cam past said ratchet lugs when said outer cap member is rotated in a closure removal direction; and said non-concentric aperture being angularly misaligned with said upstanding drive lug when said leaf spring members are drivingly engaging said ratchet lugs.

* * * * *